US009827766B2

(12) United States Patent
Ito

(10) Patent No.: US 9,827,766 B2
(45) Date of Patent: Nov. 28, 2017

(54) INKJET PRINTING APPARATUS AND METHOD FOR CONTROLLING INKJET PRINTING APPARATUS

(71) Applicant: CANON FINETECH INC., Misato-shi (JP)

(72) Inventor: Hideyuki Ito, Tsukubamirai (JP)

(73) Assignee: CANON FINETECH INC., Misato-Shi (JP)

( * ) Notice: Subject to any disclaimer, the term of this patent is extended or adjusted under 35 U.S.C. 154(b) by 0 days.

(21) Appl. No.: 15/227,912

(22) Filed: Aug. 3, 2016

(65) Prior Publication Data

US 2016/0339706 A1 Nov. 24, 2016

Related U.S. Application Data

(62) Division of application No. 14/488,748, filed on Sep. 17, 2014, now Pat. No. 9,421,775.

(30) Foreign Application Priority Data

Sep. 20, 2013 (JP) ..... 2013-195870
Sep. 20, 2013 (JP) ..... 2013-195872

(51) Int. Cl.
*B41J 2/165* (2006.01)

(52) U.S. Cl.
CPC ..... *B41J 2/16508* (2013.01); *B41J 2/16505* (2013.01); *B41J 2/16517* (2013.01); *B41J 2/16526* (2013.01); *B41J 2002/16573* (2013.01)

(58) Field of Classification Search
CPC B41J 2/16508; B41J 2/16526; B41J 2/16505; B41J 2/16517; B41J 2002/16573
See application file for complete search history.

(56) References Cited

U.S. PATENT DOCUMENTS 5,065,170 A 11/1991 Rezanka et al.
6,568,780 B2 * 5/2003 Schantz ..... B41J 29/393 347/14
7,347,520 B2 3/2008 Ito
8,777,344 B2 7/2014 Ito
8,794,728 B2 8/2014 Nakano et al.
(Continued)

FOREIGN PATENT DOCUMENTS

JP 7-40539 A 2/1995
JP 10-146993 A 6/1998
(Continued)

*Primary Examiner* — Justin Seo
(74) *Attorney, Agent, or Firm* — Fitzpatrick, Cella, Harper & Scinto

(57) ABSTRACT

There is provided an inkjet printing apparatus capable of performing a printing operation to eject ink from an ejection port provided for a print head to a print medium while covering the ejection port with a capping portion in a standby state in which the printing operation is not performed, the apparatus including: a humidifying unit configured to perform a humidification operation to humidify a space formed between the capping portion and the print head in the standby state; and a control unit configured to cause the humidifying unit to perform the humidification operation on the space in the standby state, wherein the control unit suspends the humidification operation at a predetermined timing after performing the humidification operation multiple times.

9 Claims, 14 Drawing Sheets

(56) References Cited

U.S. PATENT DOCUMENTS

| | | | | |
|---|---|---|---|---|
| 2006/0221135 | A1* | 10/2006 | Silverbrook | B41J 2/1412 347/56 |
| 2006/0221137 | A1* | 10/2006 | Silverbrook | B41J 2/1412 347/56 |
| 2008/0204503 | A1* | 8/2008 | Studer | B41J 3/36 347/23 |
| 2009/0002459 | A1* | 1/2009 | Silverbrook | B41J 2/1412 347/62 |
| 2011/0205292 | A1* | 8/2011 | Kneezel | B41J 2/16526 347/29 |
| 2012/0001976 | A1* | 1/2012 | Katoh | B41J 11/007 347/16 |
| 2012/0050366 | A1* | 3/2012 | Fukasawa | B41J 2/16505 347/14 |
| 2013/0002751 | A1 | 1/2013 | Shinoda | |
| 2013/0033533 | A1 | 2/2013 | Ito | |
| 2013/0083113 | A1* | 4/2013 | Ito | B41J 2/1652 347/16 |
| 2013/0100197 | A1 | 4/2013 | Donahue et al. | |
| 2013/0100200 | A1 | 4/2013 | Hamasaki et al. | |
| 2013/0221134 | A1* | 8/2013 | Kobayashi | B05B 17/0638 239/536 |

FOREIGN PATENT DOCUMENTS

| | | | |
|---|---|---|---|
| JP | 2003-285446 | A | 10/2003 |
| JP | 2004-167912 | A | 6/2004 |
| JP | 2004-181844 | A | 7/2004 |
| JP | 2013-10300 | A | 1/2013 |
| JP | 2013-22885 | A | 2/2013 |
| JP | 2013-35152 | A | 2/2013 |
| JP | 2013-86441 | A | 5/2013 |
| WO | 2011/099230 | A | 8/2011 |

* cited by examiner

| CAP OPEN TIME | ~ 10 SECONDS | 10 SECONDS ~ 1 MINUTE | 1 MINUTE ~ |
|---|---|---|---|
| COEFFICIENT | 0.5 | 0.7 | 1 |

FIG.6

| CUMULATIVE NUMBER OF EJECTIONS (e1) | ~ 3000 EJECTIONS | 3000 ~ 6000 EJECTIONS | 6000 ~ 9000 EJECTIONS |
|---|---|---|---|
| COEFFICIENT | 1 | 0.5 | 0.3 |

FIG.7

| TEMPERATURE HUMIDITY COEFFICIENT (N) | ～20% | 20%～30% | 30%～40% | 40%～50% | 50%～60% | 60%～70% | 70%～80% | 80%～ |
|---|---|---|---|---|---|---|---|---|
| ～20℃ | 100 | 90 | 80 | 70 | 40 | 10 | 10 | 10 |
| 20℃～25℃ | 90 | 80 | 70 | 40 | 10 | 10 | 10 | 10 |
| 25℃～30℃ | 80 | 70 | 40 | 10 | 10 | 10 | 10 | 10 |
| 30℃～ | 70 | 40 | 10 | 10 | 10 | 10 | 10 | 10 |

FIG.8

| EJECTION CONDITIONS | CALCULATION FORMULAE |
|---|---|
| NUMBER OF RECOVERY EJECTIONS AFTER CAPPING | TEMPERATURE HUMIDITY COEFFICIENT × CUMULATIVE EJECTION COEFFICIENT × 1 EJECTION ... (FORMULA 1) |
| INTERVAL BETWEEN HUMIDIFICATION EJECTIONS DURING STANDBY | 720 / {(TEMPERATURE HUMIDITY COEFFICIENT - 10) × CUMULATIVE EJECTION COEFFICIENT} SECONDS ... (FORMULA 2) |

FIG.9

| EJECTION DURATION DURING STANDBY | NUMBER OF RECOVERY EJECTIONS BEFORE NEXT PRINTING OPERATION |
|---|---|
| 100 SECONDS ~ | 0.5 × TEMPERATURE HUMIDITY COEFFICIENT × CUMULATIVE EJECTION COEFFICIENT × 1 EJECTION |
| 70 ~ 100 SECONDS | 0.7 × TEMPERATURE HUMIDITY COEFFICIENT × CUMULATIVE EJECTION COEFFICIENT × 1 EJECTION |
| 30 ~ 70 SECONDS | 0.9 × TEMPERATURE HUMIDITY COEFFICIENT × CUMULATIVE EJECTION COEFFICIENT × 1 EJECTION |
| ~ 30 SECONDS | 1.0 × TEMPERATURE HUMIDITY COEFFICIENT × CUMULATIVE EJECTION COEFFICIENT × 1 EJECTION |

FIG.10

| HUMIDIFICATION EJECTION SUSPENSION TIME DURING STANDBY | NUMBER OF RECOVERY EJECTIONS BEFORE NEXT PRINTING OPERATION |
|---|---|
| ~ 1 HOUR | 0.8 × TEMPERATURE HUMIDITY COEFFICIENT × CUMULATIVE EJECTION COEFFICIENT × 1 EJECTION |
| 1 ~ 12 HOURS | 0.9 × TEMPERATURE HUMIDITY COEFFICIENT × CUMULATIVE EJECTION COEFFICIENT × 1 EJECTION |
| 12 ~ 24 HOURS | 1.0 × TEMPERATURE HUMIDITY COEFFICIENT × CUMULATIVE EJECTION COEFFICIENT × 1 EJECTION |
| 24 HOURS ~ | 5.0 × TEMPERATURE HUMIDITY COEFFICIENT × CUMULATIVE EJECTION COEFFICIENT × 1 EJECTION |

FIG.11

| HUMIDIFICATION EJECTION DURATION DURING STANDBY | COEFFICIENT OF HUMIDIFICATION EJECTION INTERVAL DURING STANDBY |
|---|---|
| ~ 3 MINUTES | 1 |
| 3 MINUTES ~ 1 HOUR | 2 |
| 1 HOUR ~ | 5 |

FIG.14

INKJET PRINTING APPARATUS AND METHOD FOR CONTROLLING INKJET PRINTING APPARATUS

This application is a divisional of U.S. Application Ser. No. 14/488,748, filed Sep. 17, 2014 (pending), the contents of which are incorporated herein by reference.

BACKGROUND OF THE INVENTION

Field of the Invention

The present invention relates to an inkjet printing apparatus for printing an image by using a print head capable of ejecting ink and a method for controlling the inkjet printing apparatus.

Description of the Related Art

An inkjet printing apparatus prints an image on a print medium by ejecting ink, which is a printing agent, from a plurality of ejection ports formed on a print head. As for the print head used in the inkjet printing apparatus, there is known a print head in which an ejection energy generation element, such as an electrothermal transducer or an electromechanical transducer, is arranged in a liquid path that is in communication with the ejection ports, and the ejection energy causes ink in the liquid path to be ejected from the ejection ports. Some of the inks used for printing use water as a solvent, and when exposed to the air, the water serving as the solvent evaporates to cause an increase in viscosity (thickening of the ink). If the viscosity of the ink in the print head increases, the ejection of the ink during the printing operation becomes unstable, leading to a decrease in image quality. Accordingly, the currently used inkjet printing apparatus performs ink discharge processing to discharge the thickened ink or the ink containing dust or the like from the print head before printing an image.

Further, the inkjet printing apparatus is provided with a capping portion for covering (capping) an ejection port surface on which the ejection ports of the print head are formed as a configuration of preventing the ink in the print head from thickening during ejection standby in which a printing operation is not performed. However, the capping portion is often shared as an ink accepting member for accepting the thickened ink discharged from the print head due to the limit of the body size of the inkjet printing apparatus. Therefore, a capping portion needs to have a capacity for accepting the discharged ink, and accordingly a predetermined shielded space which is shielded from outside air is formed between the ejection port surface of the print head and the capping portion in a state in which the print head is capped. This causes the ejection ports to be in contact with air in the shielded space even after the capping, and the ink near the ejection ports is occasionally thickened. In addition, after capping the print head and depending on hermeticity of the capping portion, water may gradually evaporate over time to the outside of the capping portion. This may promote the thickening of the ink.

To reduce the thickening of the ink after the capping, Japanese Patent Laid-Open No. 2004-181844 discloses a technique of providing a printing apparatus body and a print head with a humidity sensor to regularly predict a humidity inside a capping portion and performing ejection to the capping portion the number of times corresponding to the predicted humidity.

In the technique disclosed in Japanese Patent Laid-Open No. 2004-181844, however, the ejection continues according to the humidity, and therefore the volume of ink to be discarded increases.

SUMMARY OF THE INVENTION

An object of the present invention is to provide an inkjet printing apparatus and a method therefor capable of suppressing a volume of ink ejected to a capping portion and maintaining an ejection performance of a print head in a standby state in which ejection ports of the print head are covered with a capping portion.

To achieve the above object, the present invention has the following configuration.

That is, in a first embodiment of the present invention, there is provided an inkjet printing apparatus capable of performing a printing operation to eject ink from an ejection port provided for a print head to a print medium while covering the ejection port with a capping portion in a standby state in which the printing operation is not performed, the apparatus including: a humidifying unit configured to perform a humidification operation to humidify a space formed between the capping portion and the print head in the standby state; and a control unit configured to cause the humidifying unit to perform the humidification operation on the space in the standby state, wherein the control unit suspends the humidification operation at a predetermined timing after performing the humidification operation multiple times.

According to the present invention, in the standby state in which the ejection ports of the print head are covered with the capping portion, it is possible to suppress a volume of ink ejected to a capping portion and appropriately maintain an ambient humidity of the print head. This allows an ejection performance of the print head to be properly maintained, and accordingly, an excellent image quality can be obtained while an increase in the running cost associated with ink ejection can be suppressed.

Further features of the present invention will become apparent from the following description of exemplary embodiments (with reference to the attached drawings).

BRIEF DESCRIPTION OF THE DRAWINGS

FIG. 6 is a table for converting an influence of a capping member open time into a coefficient of a preliminary ejection amount;

FIG. 7 is a table for converting an influence of a cumulative ejection amount into a coefficient of a humidification ejection amount;

FIG. 8 is a table for converting an influence of an ambient temperature and an ambient humidity into a coefficient of a humidification ejection amount;

FIG. 9 is a table showing calculation formulae used for determining the number of recovery ejections after capping and an interval between humidification ejections;

FIG. 10 is a table showing formulae used for determining the number of recovery ejections before a printing operation with respect to an ejection duration during standby;

FIG. 11 is a table showing formulae used for determining the number of recovery ejections before a printing operation with respect to an ejection suspension time during standby;

FIG. 14 is a table showing an ejection duration during standby and a coefficient of ejection intervals during standby.

DESCRIPTION OF THE EMBODIMENTS

Embodiments of the present invention will be described below.

(First Embodiment)

Figure 1:
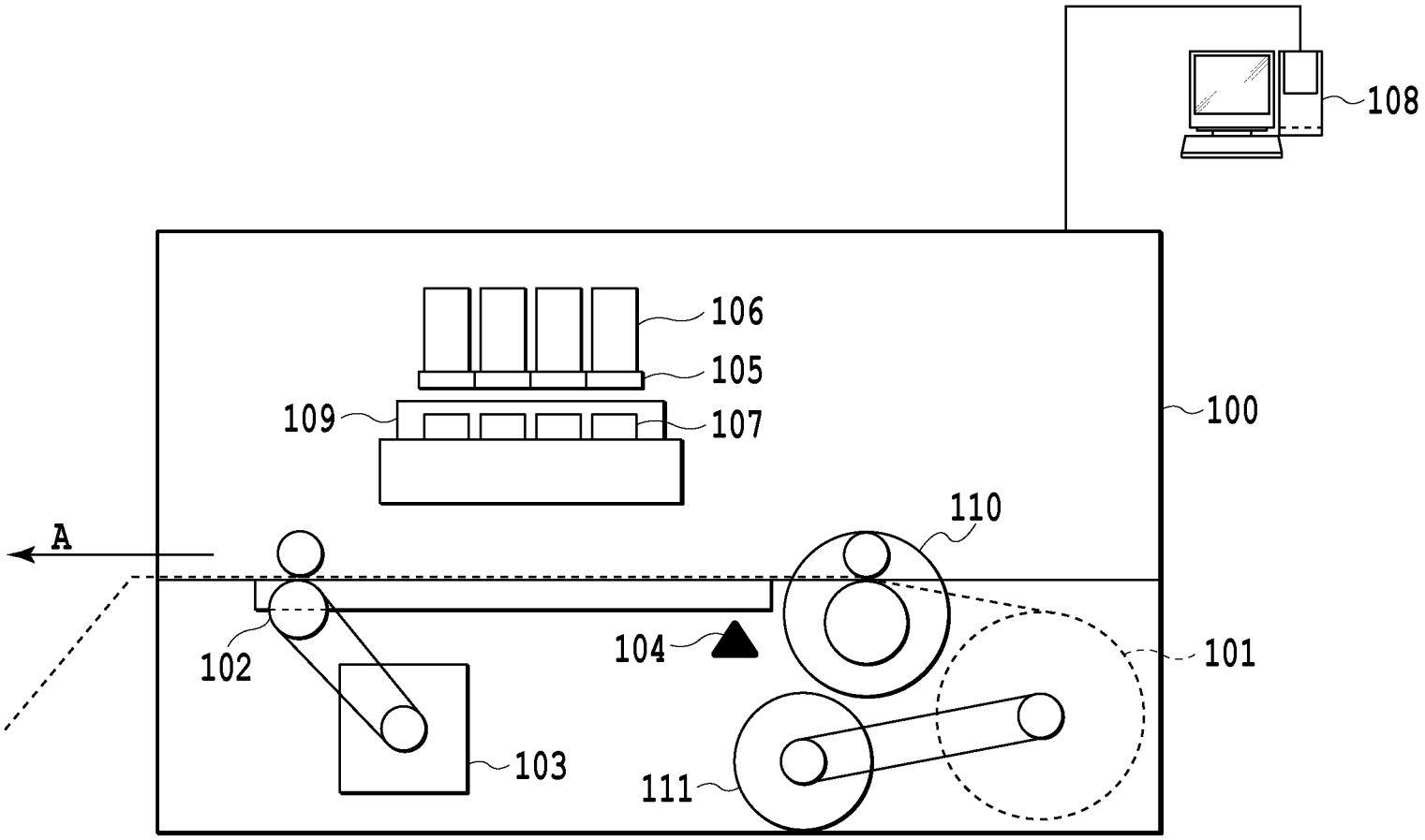
FIG. 1 is a schematic diagram showing an embodiment of an inkjet printing apparatus according to the present invention.

FIG. 1 is a schematic diagram showing an inkjet printing apparatus of the present invention. A printing apparatus 100 of the present embodiment uses, as a print medium, a label sheet 101 made of a plurality of labels tentatively attached to a long strip of paper wound up in a roll. The label sheet 101 is conveyed at a constant speed in a direction shown by an arrow A (conveying direction) by a conveying roller 102 that rotates with a driving force of a conveying motor 103. When each of the labels tentatively attached to the conveyed label sheet 101 passes under a print head 105, ink is ejected from ejection ports of a plurality of nozzles of the print head 105 arranged opposite to a conveying path of the label sheet 101, and an image is printed on each label of the label sheet 101. The ink ejection operation (printing operation) of the print head to each label is performed based on a detection of a front end of the label by a label sensor 104. That is, the label sensor 104 is arranged at a predetermined detection position upstream of the print head 105 in the conveying path. In a case where a front end of a label is detected by the label sensor, ink is ejected from the ejection ports and an image is printed at a time when the label reaches a predetermined printing position.

In the present embodiment, as the print head 105 for ejecting ink to labels, a plurality of print heads 105K, 105C, 105M, and 105Y are arranged in the conveying direction upstream of the conveying path. The print heads 105K, 105C, 105M, and 105Y respectively eject black, cyan, magenta, and yellow inks, so that a color image can be printed. The print head 105 is a line head having a long length and a printing width corresponding to a maximum width of the label sheet 101. On lower surfaces of the print heads (ejection port surfaces), a plurality of ejection ports capable of ejecting ink are arranged. An arrangement direction of the plurality of ejection ports on each ejection port surface of the print head is a direction crossing the conveying direction A of labels (a direction perpendicular to the conveying direction A in this example). Incidentally, in the following description, the ejection ports and a portion indicating the liquid path that is in communication with the ejection ports are also referred to as a nozzle.

In the liquid path provided in a manner corresponding to the ejection ports of each of the print heads, there is provided an ejection energy generation element to eject ink supplied from an ink tank 106 from the ejection ports which are openings formed at a front end of the liquid path. Examples of the ejection energy generation element include an electrothermal converting element (heater) and a piezoelectric element. In the print head using the heater, ink in a nozzle is bubbled with heat generated by the heater, and the ink is ejected from the ejection ports with pressure at the time of bubbling.

In an upper part of the printing apparatus 100, there is provided the ink tank 106 (106K, 106C, 106M, and 106Y) for supplying inks to the print head 105 (105K, 105C, 105M, and 105Y). In a lower part of the print head 105, there is provided a capping mechanism 107 (a capping portion) having a capping member capable of covering the ejection ports of the print head 105 and the ejection port surface on which the ejection ports are formed in a state cut off from outside air. The print head 105 and the capping mechanism 107 are relatively movable in a horizontal direction in FIG. 1. The capping mechanism 107 covers the ejection port surface of the print head 106 to prevent dust from adhering to the ejection port surface or the ejection ports, to avoid damage to the ejection port surface or the ejection ports, and to prevent the ink in the print head 105 from thickening, solidifying, or the like by being cut off from the outside air. Furthermore, to keep a favorable ejection condition of the print head 105, the capping mechanism 107 is used for a recovery operation to discharge the thickened ink or the ink containing dust or the like that exists in the ejection ports, the liquid path, or the like of the print head 105. Examples of the recovery operation include a recovery ejection for driving the ejection energy generation element to discharge the ink near the liquid path or the ejection ports in a standby state in which the capping member of the capping mechanism 107 covers the ejection port surface of the print head. Other examples of the recovery operation are a suction recovery for sucking the ink in the print head 105 from the ejection ports to the capping member of the capping mechanism 107 and a pressurizing recovery for pressurizing the ink in the print head 105 to discharge it from the nozzle to the capping member.

The printing apparatus 100 is connected to an external computer (host device) 108, and an image can be printed based on print data received from the computer 108.

Figure 2:
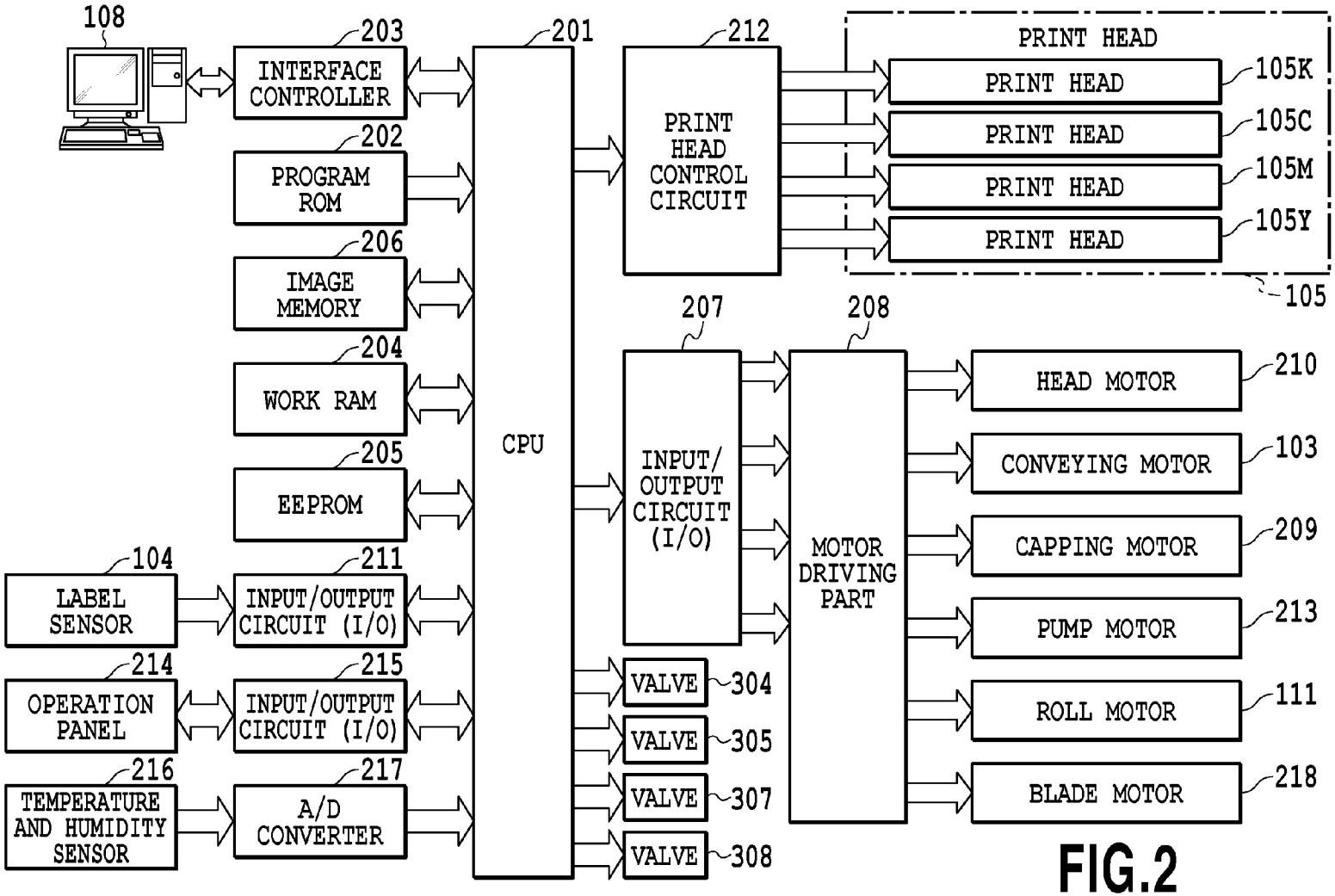
FIG. 2 is a block diagram showing a schematic structure of a control system of the present invention.

FIG. 2 is a block diagram showing a schematic structure of a control system of the printing apparatus 100 of FIG. 1. The major part of the control system of the printing apparatus 100 is a CPU 201 as a central processing unit for controlling the entire apparatus. That is, the CPU 201 executes a program stored in a program ROM 202 and controls the operations of the parts in the printing apparatus 100, which will be described later. The print data transmitted by the computer device 108 is received at an interface controller 203 of the printing apparatus 100. Commands for instructing the number of labels, the type and size of the label as a print medium, or the like are inputted to the CPU 201 via the interface controller 203 and analyzed by the CPU 201. The CPU 201 not only analyzes the commands, but also executes computation for controlling the entire printing apparatus 100 such as print data reception, printing operation, print medium handling, and the like. The programs executed by the CPU 201 include a program corresponding to a procedure shown in the flowchart of FIG. 5, which will be described later. Furthermore, a work RAM 204 is used for a working memory of the CPU 201. An EEPROM 205 is an erasable nonvolatile memory. The EEPROM 205 stores parameters specific to the printing apparatus 100 such as a time at which the last recovery operation was performed, a distance between print heads, a corrected value for fine adjusting a print position in a conveying direction (registration in a vertical direction), and the like.

A control operation performed by the control system configured in the above manner will be described.

After analyzing the received commands, the CPU 201 expands the print data on each color component of the print data into an image memory 206 in a bitmap format. The CPU 201 also controls a capping motor 209 for driving the capping mechanism 107, a head motor 210 for moving the print head 105 in a vertical direction, and a blade motor 218 for operating a blade 109 via an input/output circuit (I/O) 207 and a motor driving part 208. The head motor 210 allows the print head 105 to move among a capping position (standby position) at which the ejection port surface comes in contact with the capping member, a print position at which an image is printed, and an evacuation position at which the ejection port surface is separated upwardly from the capping member.

In printing an image, the conveying roller 102 is driven by the conveying motor 103 to convey the label sheet 101 at a constant speed. To determine a print timing of an image on each label of the label sheet 101 conveyed at a constant speed, a front end of the label is detected by the label sensor 104. A detection signal of the label sensor 104 is inputted via an input/output circuit (I/O) 211. In synchronism with a signal outputted from an encoder 110 according to the conveyance of the label sheet 101 by the conveying motor 103, the CPU 201 sequentially reads out the print data on each color from the image memory 206. Furthermore, the CPU 201 transfers the read print data to the corresponding print head 105 via a print head control circuit 212. Accordingly, the print head 105 ejects ink based on the print data to print an image on the label. Note that a roll motor 111 is used to rewind the label sheet.

A pump motor 213 for driving a pump, which will be described later, is controlled via the input/output circuit (I/O) 207 and the motor driving part 208. An operation panel 214 is connected to an input/output circuit (I/O) 215. An ambient temperature and an ambient humidity of the printing apparatus 100 are detected by a temperature and humidity sensor 216. After A/D converted by an A/D converter 217, the detection signal is inputted to the CPU 201. Further, the CPU 201 is connected to a valve 304, a valve 305, a valve 307, and a valve 308 and controls them.

Figure 3:
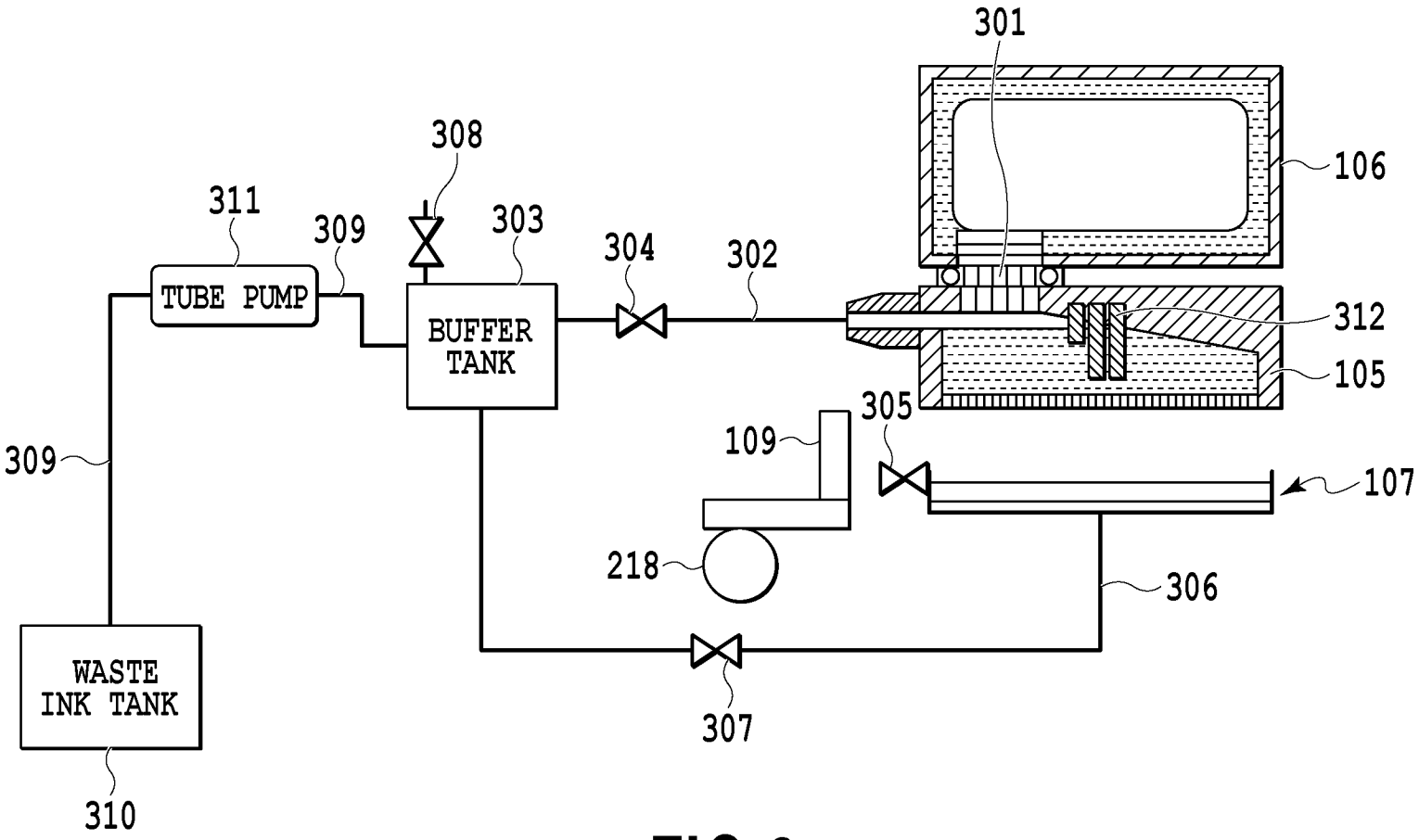
FIG. 3 is a diagram showing a schematic structure of an ink supply system of the present invention.
Figure 4:
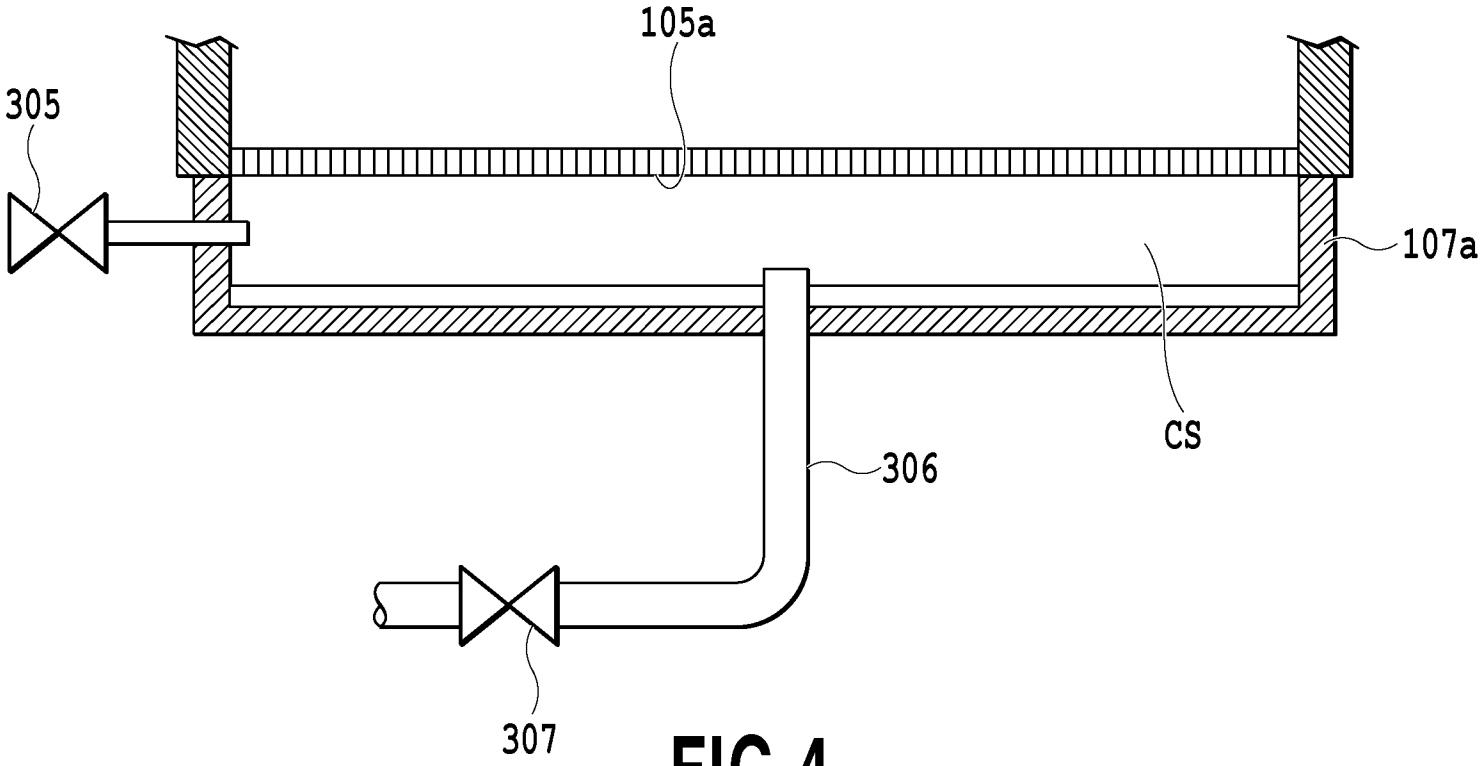
FIG. 4 shows a shielded space formed by a capping member and an ejection port surface.

FIG. 3 shows one of the ink flow path systems provided for respective inks of four colors in the printing apparatus 100. In the present embodiment, the ink tank 106 is connected to the print head 105 via a connection member 301. The print head 105 is coupled to a buffer tank 303 via a tube 302 and the middle of the tube 302 is coupled to the valve 304 for opening and closing a flow path inside the tube 302. In the capping mechanism 107, when the print head 105 is capped with a capping member 107*a*, the capping member 107*a* and an ejection port surface 105*a* of the print head 105 form a shielded space CS as shown in FIG. 4. Further, to adjust the internal pressure of the shielded space CS, the capping member 107*a* is coupled to the air communication valve 305 that switches between the state in which the capping member 107*a* is in communication with air and the state in which the capping member 107*a* is shielded from air. The capping member 107*a* of the capping mechanism 107 is in communication with the buffer tank 303 via the tube 306 and a tube pump 311, and the middle of the tube 306 is coupled to the valve 307 for opening and closing a flow path inside the tube 306. The buffer tank 303 is coupled to the valve 308 that adjusts the internal pressure of the buffer tank 303, and to a waste ink tank 310 via a tube 309. The middle of the tube 309 is coupled to the tube pump 311. A liquid level sensor 312 that detects a liquid level of ink is provided inside the print head 105. Note that the ink tank 106 is configured to be biased in a direction in which an ink bag is opened by a spring and to generate a negative pressure.

To fill the print head 105 with ink, the valves 307 and 308 are closed and the valve 304 is opened, and the pump motor 213 is driven to operate the tube pump 311, so that the internal pressure of the print head 105 falls below the internal pressure of the ink tank 106. Accordingly, the print head 105 is filled with ink via the connection member 301.

In a case where the ink in the print head 105 is used by the printing operation, the internal pressure of the print head 105 decreases. In a case where the internal pressure of the print head 105 falls below the internal pressure of the ink tank 106, the ink is supplied from the ink tank 106 to the print head 105 through the connection member 301. Basically, the ink flow path system shown in FIG. 3 can be formed for each of the four types of inks. In the present embodiment, however, the flow path from the air communication valve 308 and the buffer tank 303 to the waste ink tank 310 is used as a common part for the respective ink flow path systems. Note that each of the above-described valves is opened or closed by a solenoid (not shown) or the like.

The recovery operations performed in the present embodiment include the above-described recovery ejection and suction recovery and a wipe recovery for wiping out dust or ink adhering to the ejection port surface of the print head 105 with use of a wiping blade. These operations may be used in combination.

In the case of performing the suction recovery, first, the capping member 107*a* is brought in contact with the ejection port surface 105*a* of the print head 105 to have a capping state, and the tube pump 311 is operated in a direction in which the internal pressure of the buffer tank 303 is reduced in a state in which all of the valves are closed. Then, the valve 307 is opened at the time when the pressure in the buffer tank 303 reaches a predetermined pressure that is lower than the internal pressure of the print head 105. Accordingly, the shielded space CS formed between the capping member and the ejection port surface 105*a* of the print head 105 is communicated with the buffer tank 303, and the ink in the buffer tank 303 is sucked into the capping member 107*a* with a low pressure of the shielded space CS. Then, the thickened ink, the ink containing dust in the liquid path, or the like is discharged into the capping member 107. As a result, the ink in the print head 105 is replaced with a new ink suitable for ejection, and a favorable ejection condition can be obtained.

The wipe recovery is performed in a manner that the ink which has adhered to the ejection port surface 105*a* of the print head 105 as a result of the above-described suction recovery operation or the like is wiped out with a blade 109 that is in contact with the ejection port surface 105*a* and reciprocates by the blade motor 218. After this wipe recovery, ink is ejected to the capping member 105*a* to control a meniscus of the ink in the ejection ports. When a cumulative volume of ink ejected to the capping member 107*a* reaches a predetermined volume, the ejection port surface 105*a* of the print head 105 is separated from the capping member 107*a*, and in a state in which the valve 304 and the valve 308 are closed and the valve 307 is opened, the tube pump 311 is operated. Accordingly, the ink accumulated in the capping member 105*a* is discarded to the waste ink tank 310.

Next, with reference to the flowchart of FIG. 5 and the control parameter tables of FIG. 6 to FIG. 11, a description will be given of an operation procedure from immediately after the capping operation, through a humidification ejection as a humidification operation performed during printing operation standby, and a recovery ejection performed before a printing operation, to the printing operation. Note that the control parameter tables of FIG. 6 to FIG. 11 are stored in a storage unit of the control system of FIG. 2, such as the program ROM 202.

In a standby state in which the printing operation is not performed, the print head 105 is capped by the capping member 107*a* of the capping mechanism 107. This capping is performed after the last printing operation ends (S1). If the capping is performed, the CPU 201 obtains the cumulative number of ejections of ink droplets corresponding to a volume of ink accumulated in the capping member 107*a* (the cumulative number of ejection operations) and obtains an ambient temperature and an ambient humidity of the printing apparatus detected by the temperature humidity sensor 216 (S2, S3). The CPU 201 also obtains a coefficient corresponding to a time in which capping is not performed during the last printing operation (cap open time) based on the table shown in FIG. 6. Further, the CPU 201 obtains a temperature humidity coefficient corresponding to the detected temperature and humidity based on the table shown in FIG. 8, and on the basis of the temperature humidity coefficient, determines ejection conditions for ink ejection operations performed after the capping and in the capping state (S4). The ejection operations performed after the capping and in the capping state include a recovery ejection performed immediately after the capping to refresh the ink existing in the nozzle at the time of capping and a humidification ejection performed after the recovery ejection and in the printing standby state. Therefore, in S4, the number of recovery ejections performed immediately after the capping and the interval between the humidification ejections performed in the printing standby state are determined as the ejection conditions, and the recovery ejections and the humidification ejections are performed according to the determined ejection conditions (S5, S6).

The cumulative number of ejections corresponding to the volume of ink accumulated in the capping member 107*a* (see FIG. 7), the time in which capping is not performed (see FIG. 6), and the ambient temperature and the ambient humidity of the printing apparatus (see FIG. 8) have an influence on the humidity in the capping member 107*a* immediately after the capping. Accordingly, in a case where the time in which capping is not performed is long and the ambient temperature and the ambient humidity are low, for example, it is determined that the humidity in the capping mechanism 107 is low. In this case, the recovery ejection amount immediately after the capping is increased and the time interval between the humidification ejections performed in the printing standby state (humidification interval) is decreased, so that the humidity in the capping mechanism 107 is appropriately maintained. Note that the recovery ejection also plays a role as a humidification ejection (a role of humidifying the shielded space CS). Reversely, in a case where the time in which capping is not performed is short and the ambient temperature and the ambient humidity are high, the recovery ejection amount immediately after the capping and the humidification ejection amount are decreased and the time interval between the humidification ejections is increased. Accordingly, an appropriate volume of ink without deficiency and excess can be given to the capping member 107*a* in the capping state, and an ambient humidity of the print head can be appropriately maintained. In the present embodiment, as described above, the print head functions as a humidifying unit for maintaining a humidity of the shielded space CS formed between the capping member 107*a* and the ejection port surface 105*a* of the print head 105.

The recovery ejection amount (the number of ejections) and the humidification ejection amount (the number of humidification ejections) can be controlled by changing their respective ejection frequencies, and also by changing the recovery ejection operation time and the humidification ejection operation time. That is, to increase the ejection amount, the ejection frequency may be increased or the ejection time may be increased. It is also possible to control the ejection amount by changing both of the ejection frequency and the operation time. In addition, the cumulative ejection amount (the cumulative number of ejections) is configured to be reset by discarding the ink accumulated in the capping member 107*a* into the waste ink tank 310 with use of the tube pump.

In the present embodiment, by using the temperature humidity coefficient shown in FIG. 8 and the cumulative ejection coefficient shown in FIG. 7, the number of ink ejections (ejection after capping) Na performed after the capping and in the capping state is determined based on a calculation formula (Formula 1) in the ejection setting table shown in FIG. 9. That is, Na is obtained by the following Formula 1:

$$Na = \text{temperature humidity coefficient } (N) \times \text{cumulative ejection coefficient } (e1) \times 1 \text{ ejection.}$$

Note that Formula 1 is applied when N>10. When N=10, Na=0 is set irrespective of the cumulative number of preliminary ejections.

Now, in a case where the ambient temperature is 23° C. and the ambient humidity is 20% as the ejection conditions after the capping, a temperature humidity coefficient N as obtained from the table of FIG. 8 is 90. In a case where the cumulative number of ejections is 4000, the cumulative ejection coefficient (e1) as obtained from the table of FIG. 7 is 0.5. Accordingly, the cumulative number of ejections Na as set under the ejection conditions is Na=90×0.5×1 ejection=45 ejections.

By using the temperature humidity coefficient shown in FIG. 8 and the cumulative ejection coefficient shown in FIG. 7, the time interval between the humidification ejections performed in the standby state (humidification interval) is set based on a calculation formula (Formula 2) in the ejection setting table shown in FIG. 9. That is, a humidification interval T is obtained by the following Formula 2:

$$T = 720/\{(\text{temperature humidity coefficient } (N) - 10) \times \text{cumulative ejection coefficient } (e1)\} \times 1 \text{ second.}$$

Note that Formula 2 of FIG. 9 is applied when N>10.

Therefore, the humidification interval T set under the above-described ejection conditions is T=720/{(90−10)×0.5}×1 second=18 seconds. Incidentally, in the present embodiment, for each humidification ejection, one ejection (ink ejection) is performed from each nozzle of the print head 105. The one ejection (one-time humidification ejection) from each nozzle is performed every interval of T. However, the present invention is not limited to this, and depending on the apparatus, the number of one-time humidification ejections (depending on the volume of the capping member 107*a*, for example) may be set to two or more.

Figure 12A:
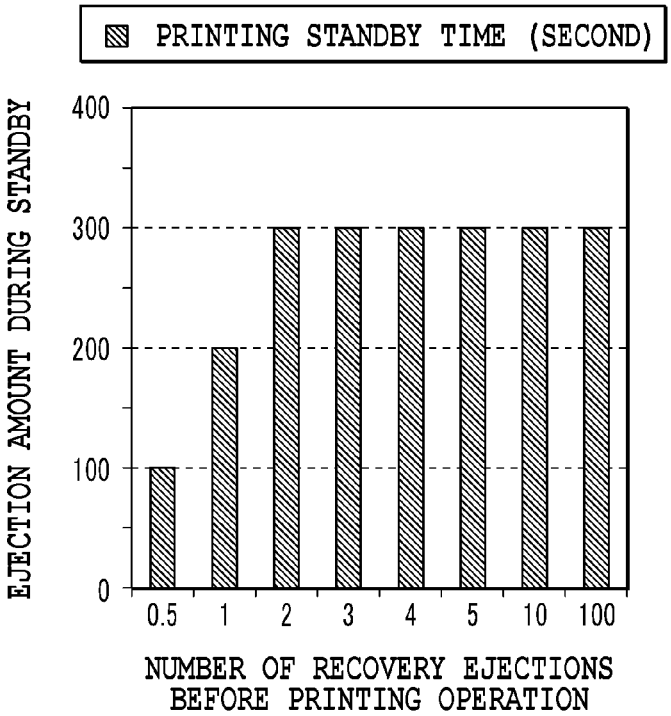
FIG. 12A is a graph showing a recovery operation amount before a printing operation required when a humidification ejection is performed.
Figure 12B:
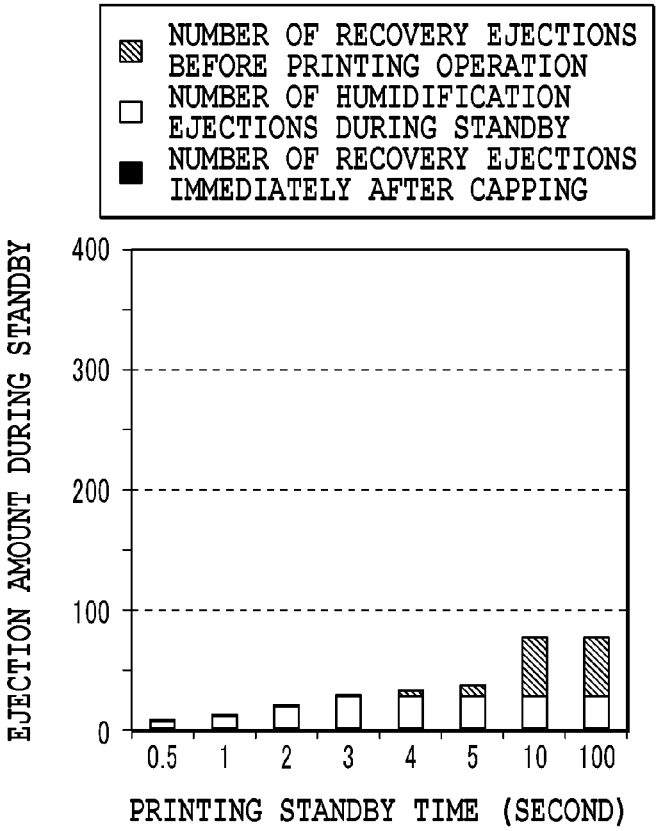
FIG. 12B is a graph showing a recovery operation amount before a printing operation required when a humidification ejection is not performed.

Referring back to FIG. 5, in a case where a printing instruction is received during a standby ejection (S7), the CPU 201 refers to the table shown in FIG. 10 and determines the number of recovery ejections to be performed immediately before the printing operation, corresponding to a duration of the humidification ejection operation performed in a standby state (an ejection duration during standby) (S8). Then, after performing the determined number of recovery ejections (S9), the CPU 201 executes the printing operation (S10). As shown in FIG. 10, in the present embodiment, in a case where the ejection duration during standby is short, the number of recovery ejections to be performed immediately before the printing operation is set large, while in a case where the ejection duration during standby is long, the number of recovery ejections to be performed immediately before the printing operation is set small. Accordingly, in the present embodiment, even in a case where the interval between the previous printing operation and the following printing operation (printing interval) is small, it is possible to appropriately maintain the ambient humidity in the shielded space CS in the standby state, and to suppress the evaporation of a solvent in the ink (thickening of the ink) in the nozzle of the print head 105. Therefore, as shown in FIG. 12B, it is possible to suppress the ink ejection amount in the recovery ejection performed immediately before the printing and to efficiently refresh the ink in the nozzle. That is, the ink usage is reduced to suppress the running cost while maintaining the ink in the nozzle of the print head in a state suitable for the printing.

On the other hand, in a system in which only the recovery ejection is performed to the capping member 107*a* immediately before the printing, the humidity in the shielded space CS does not increase sufficiently. Therefore, to refresh the ink in the nozzle, it is required to eject a large volume of ink at the time of recovery ejection as shown in FIG. 12A. As apparent from the comparison between FIGS. 12A and 12B, in the present embodiment shown in FIG. 12B, it is found that the volume of ink to be ejected into the capping member 107*a* in the standby state is greatly reduced as compared to that in the conventional system shown in FIG. 12A.

Figure 5:
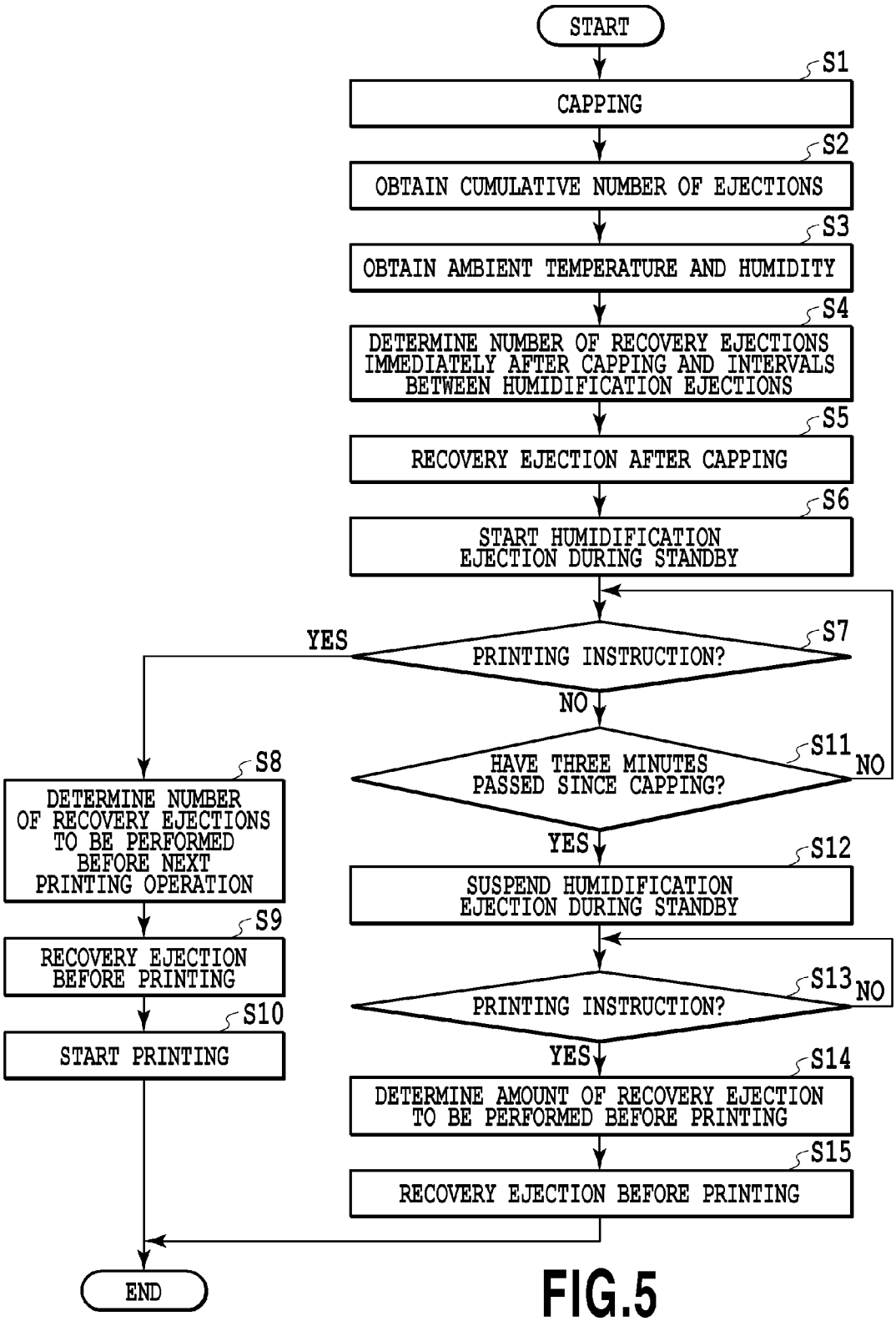
FIG. 5 is a flowchart of a control operation performed by the control system according to a first embodiment.

Further, in a case where it is determined that there is no printing instruction in S7 of FIG. 5 and that a predetermined period of time has passed since the capping was performed (three minutes in the present embodiment), that is, in a case where it is determined that the above-mentioned ejection duration during standby has reached the predetermined period of time (in a case where it is determined that a predetermined timing has come) (S11), the humidification ejection is suspended (S12). This is because if the ejection duration during standby reaches the predetermined period of time, the humidity in the capping member 107*a* increases and the evaporation rate of the ink from the ejection port decreases, and accordingly the effect of the continuation of ejection decreases. Thus, the humidification ejection is suspended to avoid needless ink ejection. At the time when the next printing instruction is received (S13), the CPU 201 refers to the table shown in FIG. 11, determines the amount of recovery ejection to be performed before the next printing according to the time in which the humidification ejection during standby was suspended (S14), and performs the recovery ejection according to the determination (S15). In this manner, even in a case where a printing standby time is long, it is possible to maintain an appropriate ink ejection amount with respect to the capping member 107*a* and efficiently humidify the shielded space CS to reduce the running cost associated with the ink usage. Incidentally, as for the humidification ejection intervals, an interval between humidification operations may be set based on at least one type of information from information such as a time in which the print head 105 is separated from the capping member 107*a*, an ambient temperature and an ambient humidity in the printing apparatus 100 at the time when the shielded space is formed by the capping member 107*a* and the print head 105, an amount of a liquid accumulated in the capping member 107*a*, a time in which the humidification operation is performed, and a duration of the standby state.

(Second Embodiment)

In a second embodiment, the same inkjet printing apparatus as that used the first embodiment is used. Therefore, the explanation of the same portion will be omitted. The portion different from the first embodiment will be described.

Figure 13:
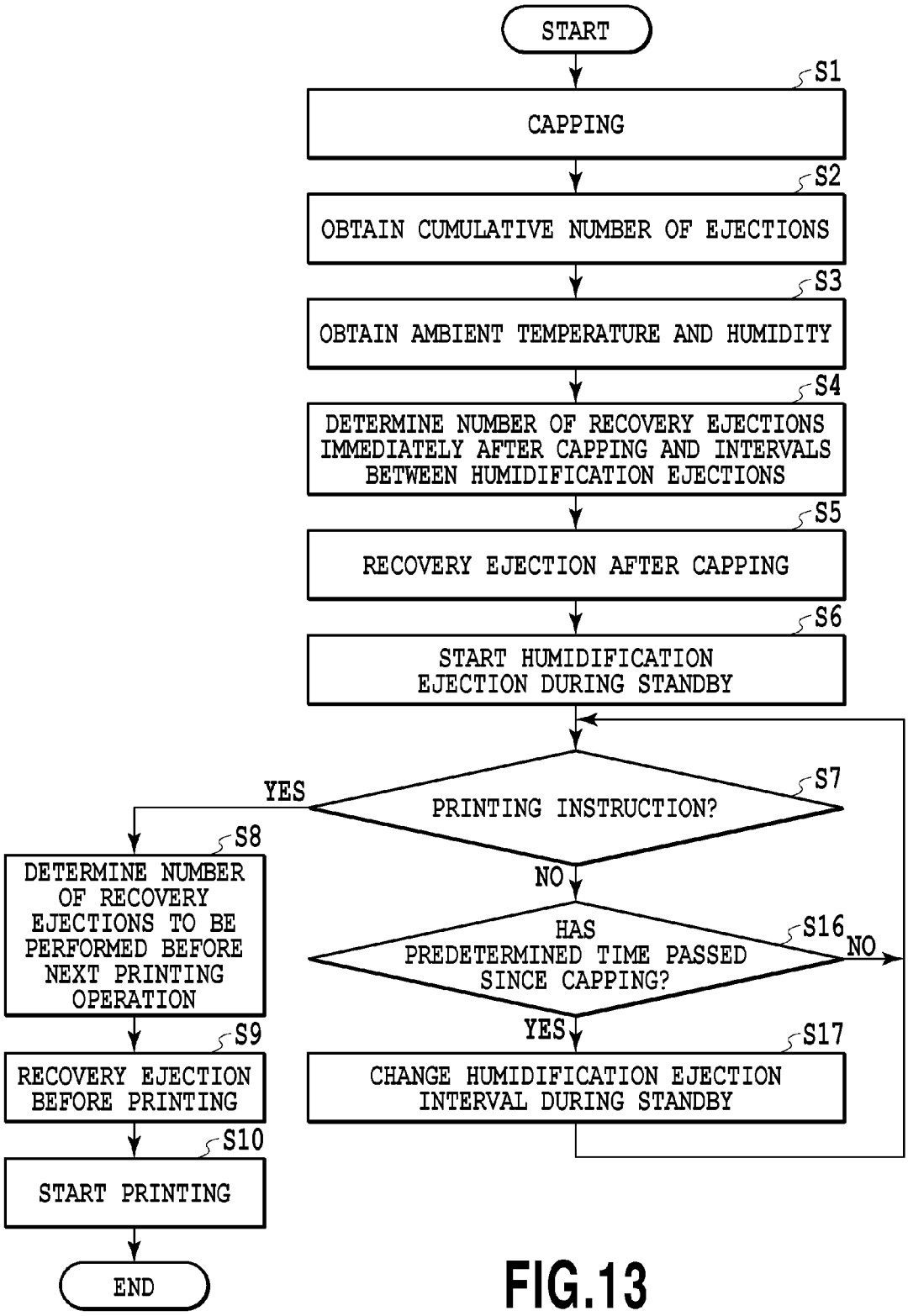
FIG. 13 is a flowchart of a control operation performed by the control system according to a second embodiment.

FIG. 13 is a flowchart of the control system performed by the CPU 201 in the second embodiment.

With reference to the flowchart of FIG. 13 and the control parameter table of FIG. 14, a description will be given of an operation procedure from immediately after a capping operation, through a humidification ejection as a humidification operation performed during printing operation standby, and a recovery ejection performed before a printing operation, to the printing operation. Incidentally, the control parameter table of FIG. 14 is stored in the storage unit of the control system of FIG. 2, such as the program ROM 202. Note that a description of the steps from S1 to S10 in the flowchart of FIG. 13 will be omitted since they are identical to those of the flowchart of FIG. 5.

In a case where it is determined that there is no printing instruction in S7 of FIG. 13 and that a predetermined period of time has passed since the capping was performed, that is, in a case where it is determined that the above-mentioned ejection duration during standby has reached the predetermined period of time (S16), the interval between the humidification ejections is changed (S17). More specifically, the interval between the previous humidification ejection operation and the following humidification ejection operation is set longer. This is because if the ejection duration during standby reaches the predetermined period of time, the humidity in the capping member 107*a* increases and the evaporation rate of the ink from the ejection port decreases, and accordingly, the interval between the humidification ejections is set longer to avoid needless ink ejection. More specifically, the humidification ejection interval is determined by multiplying the humidification ejection interval originally determined at the time of capping by the coefficient of FIG. 14. In this manner, even in a case where a printing standby time is long, it is possible to maintain an appropriate ink ejection amount with respect to the capping member 107*a* and efficiently humidify the shielded space CS to reduce the running cost associated with the ink usage. Incidentally, as for the humidification ejection intervals, an interval in between humidification operations may be set based on at least one type of information from information such as a time in which the print head 105 is separated from the capping member 107*a*, an ambient temperature and an ambient humidity in the printing apparatus 100 at the time when the shielded space is formed by the capping member 107*a* and the print head 105, an amount of a liquid accumulated in the capping member 107*a*, a time in which the humidification operation is performed, and a duration of the standby state.

(Other Embodiments)

The present invention can also be applied to an inkjet printing system provided with a plurality of devices (such as a host computer, an interface device, a reader, and a printer) and an apparatus provided with one device (such as a copying machine or a facsimile machine). The present invention may be configured as a printing system including an inkjet printing apparatus using a plurality of print heads capable of ejecting different inks and a host device capable of providing image data for the printing apparatus.

In addition, a storage medium may store a program code of software realizing the functions described in the above embodiments. In this case, it is possible to provide the program code stored in the storage medium for the printing system or the printing apparatus, and a computer (or a CPU or MPU) in the printing system or the printing apparatus reads and executes the program code stored in the storage medium. The object of the present invention can be achieved by such configurations. In this case, the program code itself read from the storage medium realizes the functions described in the above embodiments, and the storage medium having the program code stored therein forms the present invention. In a case where the present invention is applied to such a storage medium, the storage medium stores a program code corresponding to the above-described flowchart.

As the storage medium for providing a program code, it is possible to use a floppy disk (registered trademark), a hard disk, an optical disk, a magneto-optic disk, a CD-ROM, a CD-R, a BD-R, a magnetic tape, a nonvolatile memory card, a ROM, or the like. The computer executes the read program code, so that the functions described in the above embodiments can be realized. Furthermore, based on an instruction of the program code, an OS (operating system) operating on the computer or the like performs part or all of the actual processing, so that the processing can realize the functions described in the above embodiments.

In addition, the information such as the program code read from the storage medium may be loaded into a memory provided for a function expansion board inserted into the computer or a function expansion unit connected to the computer. In this case, based on an instruction of the loaded program code, a CPU or the like provided for the function expansion board or the function expansion unit performs part or all of the actual information processing, so that the processing can realize the functions described in the above embodiments.

Furthermore, the present invention is not limited to a full line-type printing apparatus like the one described in the above embodiments. It is also possible to apply the present invention to a so-called serial-type printing apparatus which performs printing operation by moving a print head in a direction crossing a conveying direction of a print medium.

The above embodiments show the examples of using the print head as a humidifying unit. However, the humidifying unit of the present invention is not limited to this, and it is also possible to humidify, during standby, the inside of the capping member by supplying a liquid from a liquid providing unit other than the print head to the shielded space formed between the ejection port surface of the print head and the capping member.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2013-195870, filed Sep. 20, 2013, No. 2013-195872, filed Sep. 20, 2013 which are hereby incorporated by reference herein in their entirety.

What is claimed is:

1. An inkjet printing apparatus capable of performing a printing operation to eject ink from an ejection port provided for a print head to a print medium while covering the ejection port with a capping portion in a standby state in which the printing operation is not performed, the apparatus comprising:

a humidifying unit configured to perform a humidification operation to humidify a space formed between the capping portion and the print head in the standby state; and a control unit configured to cause the humidifying unit to perform the humidification operation on the space in the standby state, wherein the control unit causes the humidity unit to perform the humidification operation at predetermined intervals and predetermined number of times, the predetermined intervals and the predetermined number of times being set based on at least one type of information selected from duration in which the print head is separated from the capping portion, humidity in the inkjet printing apparatus at a time when the space is formed by the capping portion and the print head, an amount of a liquid accumulated in the capping portion, a duration in which the humidification operation have been performed, and a duration of the standby state, and stop the humidification operation when the humidification operation of the predetermined number of times is performed and a predetermined time period is elapsed.

2. The inkjet printing apparatus according to claim 1, wherein the control unit sets a number of times of performing the humidification operation until the humidification operation is stopped, based on at least one type of information selected from a duration in which the print head is separated from the capping portion, humidity in the inkjet printing apparatus at the time when the space is formed by the capping portion and the print head, an amount of a liquid accumulated in the capping portion, a time in which the humidification operation is performed, and a duration of the standby state.

3. The inkjet printing apparatus according to claim 1, wherein the humidifying unit includes the print head for ejecting ink to the space.

4. The inkjet printing apparatus according to claim 1, wherein the control unit determines the number of recovery ejections performed before the next printing operation based on an elapsed time from the time when the humidification operation is suspended in the standby state.

5. The inkjet printing apparatus according to claim 1, wherein, the control unit sets an interval between a recovery ejection and a humidification ejection performed before the next printing operation based on the cumulative number of humidification operations performed on the capping portion by the time the humidification operation in the standby state is suspended.

6. The inkjet printing apparatus according to claim 1, wherein the control unit performs a recovery ejection to eject ink from the ejection port to refresh the ink in the print head immediately after the time when the space between the capping portion and the print head is formed, and performs the humidification operation after the recovery ejection.

7. The inkjet printing apparatus according to claim 1, wherein the humidification operation is a humidification ejection for humidifying the space by ejecting ink from the ejection port of the print head to the space.

8. The inkjet printing apparatus according to claim 7, wherein the control unit allows changing respective ejection frequencies of the recovery ejection and the humidification ejection.

9. A method for controlling an inkjet printing apparatus capable of performing a printing operation to eject ink from an ejection port provided for a print head to a print medium while covering the ejection port with a capping portion in a standby state in which the printing operation is not performed, the method comprising:

a humidifying step of performing a humidification operation to humidify a space formed between the capping portion and the print head in the standby state;

a control step of controlling the humidification operation on the space in the standby state, wherein the control step performs the humidification operation at predetermined intervals and number of times, the predetermined intervals and times being set based on at least one type of information selected from duration in which the print head is separated from the capping portion, humidity in the inkjet printing apparatus at a time when the space is formed by the capping portion and the print head, an amount of a liquid accumulated in the capping portion, a time in which the humidification operation is performed, and a duration of the standby state, and stops the humidification operation when the humidification operation of the predetermined number of times is performed and a predetermined time period is elapsed.

* * * * *